US005297300A

United States Patent [19]

Sheu

[11] Patent Number: 5,297,300

[45] Date of Patent: Mar. 29, 1994

[54] RECLINING BOARD WITH AN ADJUSTABLE STAND FOR USE IN A BABY BATHTUB

[76] Inventor: Miin-Tsang Sheu, No. 156 Cheng Kung Road, Chang Hua City, Taiwan

[21] Appl. No.: 80,763

[22] Filed: Jun. 24, 1993

[51] Int. Cl.[5] ..... A47K 3/024

[52] U.S. Cl. ..... 4/572.1; 4/575.1; 4/579; 4/560.1; 297/325

[58] Field of Search ..... 4/572.1, 571.1, 573.1, 4/574.1, 575.1, 577.1, 579, 560.1, 564.1, 565.1, 578.1, 586, 587, 589, 590, 611, 659; 297/325, 327, 344.1; 224/155; 482/140, 142, 143, 145, 908; 248/439, 166; 108/117, 133

[56] References Cited

U.S. PATENT DOCUMENTS

| | | | |
|---|---|---|---|
| Re. 32,806 | 12/1988 | Gurolnick | 4/572.1 |
| 1,197,657 | 9/1916 | Orofino | 4/579 |
| 1,676,354 | 7/1928 | Sachsse | 4/575.1 |
| 2,495,482 | 1/1950 | Rogatz | 4/572.1 |
| 2,509,040 | 5/1950 | Kibbe | 297/325 |
| 2,697,480 | 12/1954 | Bois et al. | 4/572.1 |
| 3,528,111 | 9/1970 | Chou | 4/572.1 |

*Primary Examiner*—Henry J. Recla
*Assistant Examiner*—Gregory M. Vidovich
*Attorney, Agent, or Firm*—Bacon & Thomas

[57] ABSTRACT

A reclining board with an adjustable stand for carrying a baby in a baby bathtub, including an oblong board having one end terminated to a hook for hooking on a baby bathtub, a stand retained collapsed by a torsional spring, and a lock device fastened to the oblong board at the bottom to lock the stand in an upstanding position to support the opposite end of the oblong board above the bottom of the baby bathtub. The stand includes a substantially U-shaped supporting tube, and two eye end rods joined by a cross rod, each eye end rod having one end pivotably connected to a respective barrel on the oblong board by a pivot bolt and an opposite end inserted into either end of the supporting tube at a desired depth and then fixed in position by a respective screw bolt.

1 Claim, 4 Drawing Sheets

RECLINING BOARD WITH AN ADJUSTABLE STAND FOR USE IN A BABY BATHTUB

BACKGROUND OF THE INVENTION

The present invention relates to a reclining board, and more particularly to a reclining board with an adjustable stand for use in a baby bathtub which can be conveniently adjusted to carry the baby in water or above water according to different washing conditions.

Washing a baby is not an easy job. Because a baby is very tender, the mother or nurse must carefully catch the baby with one hand and then wash the baby with the other hand. While washing in a baby bathtub, the baby may be hurt easily. There is disclosed a reclining board specifically designed for carrying a baby in a baby bathtub. As illustrated in FIG. 1, the reclining board has one end terminated to a hook hooked on one end of the baby bathtub, and an opposite end curved downwards and stopped at the bottom of the baby bathtub. After being put on the reclining board, the body of the baby is dipped in water. Therefore the mother or nurse can conveniently wash the baby with less effort. This structure of reclining board is effective only when the baby is to be washed in water. When to apply a soap, the baby must be turned upwards from the lying position into the sitting position, or carried away from the water. When washing the hair, the head of the baby shall be turned backwards or downwards so that water does not enter the ears or the nostrils. However, turning the head backwards or downwards will make the baby uncomfortable. People may prepare a small reclining chair for carrying the baby as the baby is removed from the baby bathtub for applying a soap. Preparing an additional reclining chair needs much room space and will complicate the washing procedure. Further, the baby must be well wrapped with a bath towel when the bay is put on the reclining chair for washing the hair. Therefore this structure of reclining board is still not satisfactory in function.

SUMMARY OF THE INVENTION

The present invention has been accomplished under the aforesaid circumstances. One object of the present invention is to provide a reclining board with an adjustable stand which can be conveniently installed in any of a variety of baby bathtubs and disposed in either position to carry the body of a baby under the water or above the water according to different washing conditions.

It is another object of the present invention to provide a reclining board with an adjustable stand which can be conveniently adjusted according to the depth of the baby bathtub being used.

It is still another object of the present invention to provide a reclining board with an adjustable stand which can be conveniently operated to turn the stand from the non-operative position to the operative position.

It is still another object of the present invention to provide a reclining board with an adjustable stand which is safe in use.

It is still another object of the present invention to provide a reclining board with an adjustable stand which is suitable for use in any of a variety of baby bathtub.

According to the preferred embodiment of the present invention, the reclining board with an adjustable stand comprises an oblong board, which has one end terminated to a hook for hooking on a baby bathtub at one end, a stand pivotably connected to two spaced barrels on the reclining board by a pivot bolt, a torsional spring mounted on a cross rod of the stand to retain the stand in the non-operative position closely received to the back of the oblong board, and a lock device fastened to the oblong board at the bottom to lock the stand in the operative position as the stand is turned outwards to support the opposite end of the oblong board above the bottom of the baby bathtub. The stand comprises two parallel eye end rods connected by a cross rod, and a substantially U-shaped supporting tube connected to the parallel eye end rods. The sloping position of the oblong board is changed by adjusting the relative positions between the eye end rods and the two opposite ends of the U-shaped supporting tube.

DETAILED DESCRIPTION OF THE PREFERRED EMBODIMENT

Figure 2:
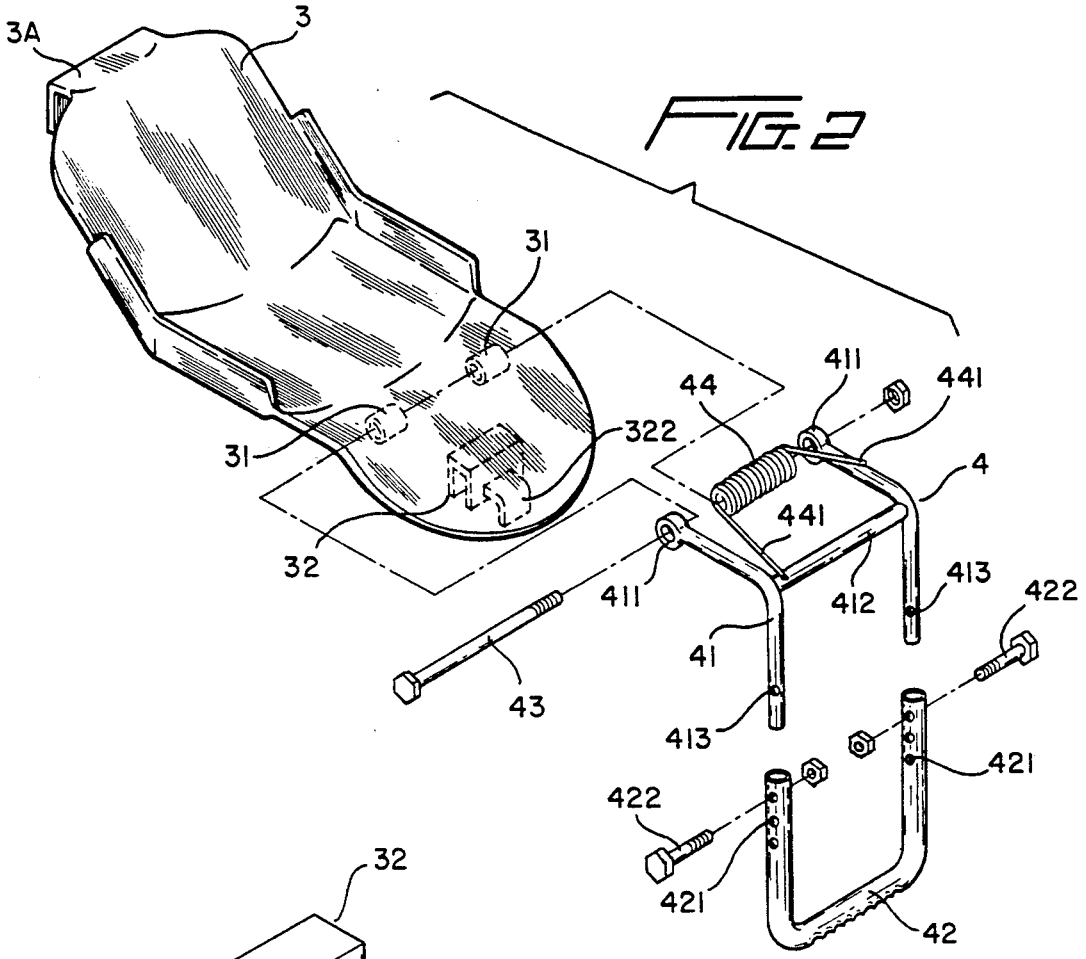
FIG. 2 is a perspective exploded view of a reclining board according to the preferred embodiment of the present invention.
Figure 3:
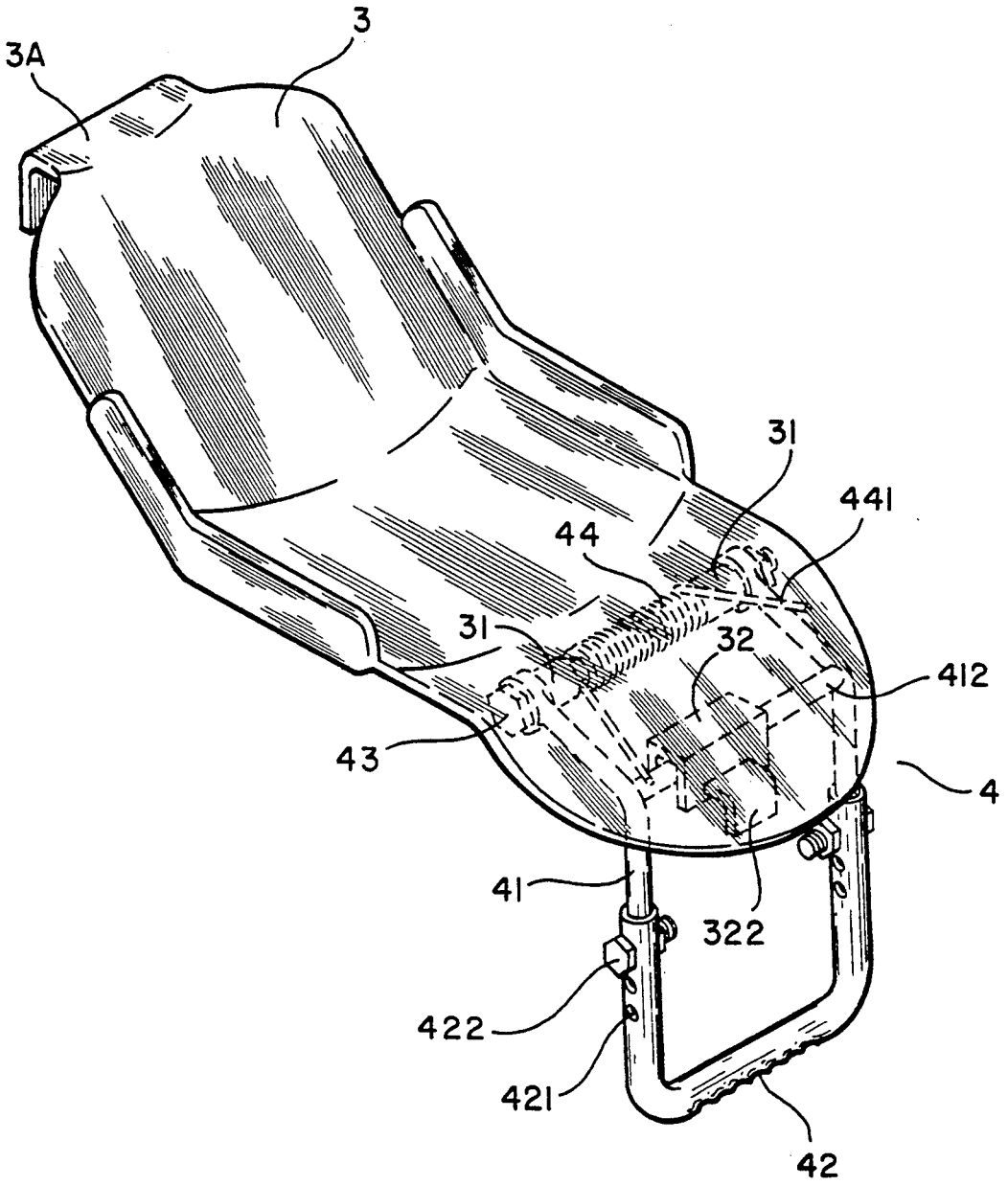
FIG. 3 is a perspective assembly view of the reclining board shown in FIG. 2.

Referring to FIGS. 2 and 3, a reclining board with an adjustable stand in accordance with the preferred embodiment of the present invention is generally comprised of a body 3 and a stand 4.

Figure 2A:
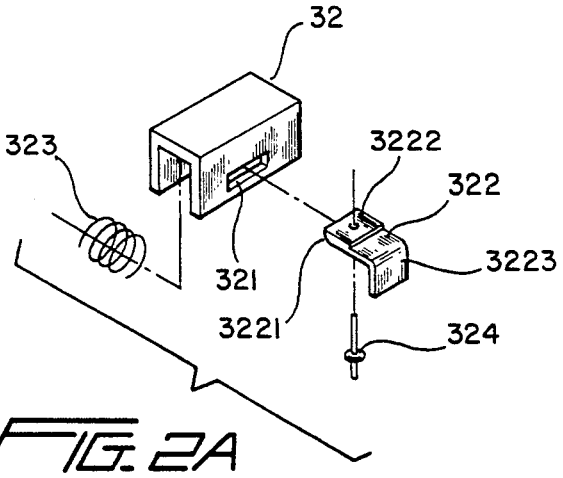
FIG. 2A is a perspective exploded view of a lock device according to the present invention.
Figure 2B:
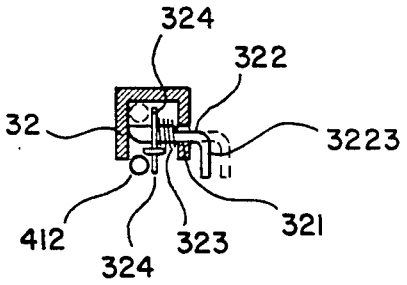
FIG. 2B is a cross sectional view of the lock device showing the handle of the latch thereof moved to compress the coil spring thereof.

Referring to FIGS. 2A and 2B, and FIGS. 2 and 3 again, the body 3 is made in a curved oblong FIGURE having a curved top surface made to the comfort of the body lying on. A hook 3A is projected from the front end of the body 3 for hooking on the edge of a baby bathtub. A channel casing 32 is transversely disposed on the bottom surface of the body 3 near the rear end thereof. Two spaced barrels 31 are made on the bottom surface of the body 3, equally spaced from the channel casing 32, and transversely aligned at two opposite sides. The opening defined within the channel casing 32 is disposed downwards. The channel casing 32 has a slot 321 on the outer side wall thereof into which latch 322 is inserted. The latch 322 comprises a sloping guide edge 3221 on a front end thereof, a pin hole 3222 spaced from the sloping guide edge 3221, and a rear end bent downwards at right angles and formed into a handle 3223. As the front end of the latch 322 is inserted into the slot 321, a coil spring 323 is mounted on the latch 322 inside the channel casing 32, and then a pin 323 is inserted in the pin hole 3222 to retain the coil spring 323 between the inner side wall of the channel casing 32. Therefore, the coil spring 323 gives a forward pressure to the latch 322, causing the front end of the latch 322 to be completely received inside the channel casing 32. The aforesaid channel casing 32, latch 322, coil spring 323, and pin 324 form into a lock device to lock the stand 4 in the operative position for allowing the body 3 to be supported by the stand 4 above the bottom of the baby bathtub.

The stand 4 comprises two eye end rods 41 parallelly joined by a cross rod 412 in the middle, and a substantially U-shaped supporting tube 42 connected to the eye end rods 41. Each eye end rod 41 has one end terminated to an eye 411 respectively connected to either barrel 31 by a pivot bolt 43. A torsional spring 44 is mounted around the pivot bolt 43, having two opposite ends 441 respectively stopped against the bottom surface of the body 3 and the cross rod 412 of the stand 4. The plain end of each eye end rod 41 has a through hole 413 in the transverse direction, and is inserted into either end of the U-shaped supporting tube 42. The U-shaped supporting tube 42 has two series of through holes 421 transversely made through two opposite ends thereof at different elevations and respectively longitudinally aligned. As the eye end rods 41 are respectively inserted into the two opposite ends of the U-shaped supporting tube 42, the eye end rods 41 and the U-shaped supporting tube 42 are firmly connected together by screw bolts 422. By inserting the screw bolts 422 into different through holes 421 on the two opposite ends of the U-shaped supporting tube 42, the elevation of the eye end rods 41 on the U-shaped supporting tube 42 is changed.

Figure 4B:
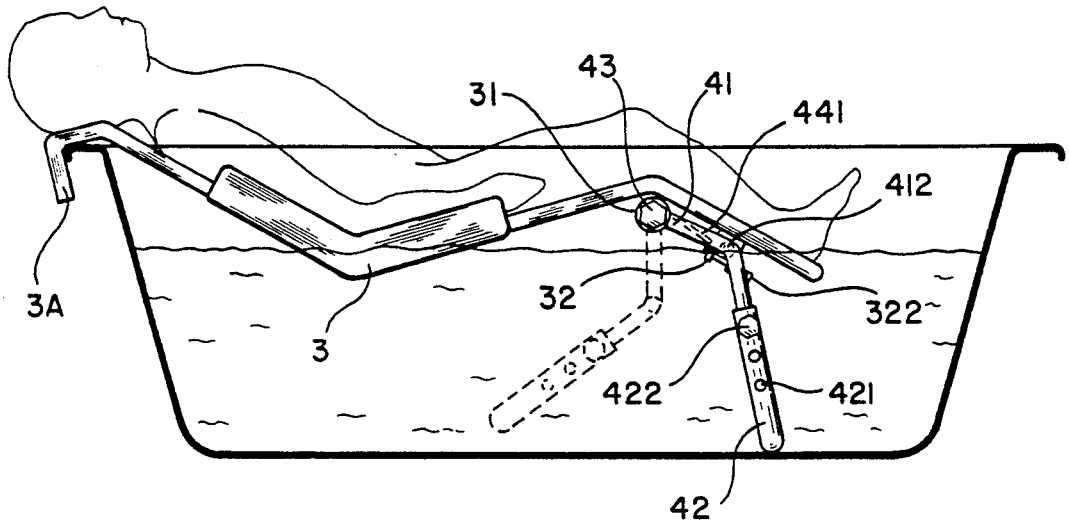
FIG. 4B is similar to FIG. 4A but showing the stand moved from the non-operative position to the operative position.
Figure 4A:
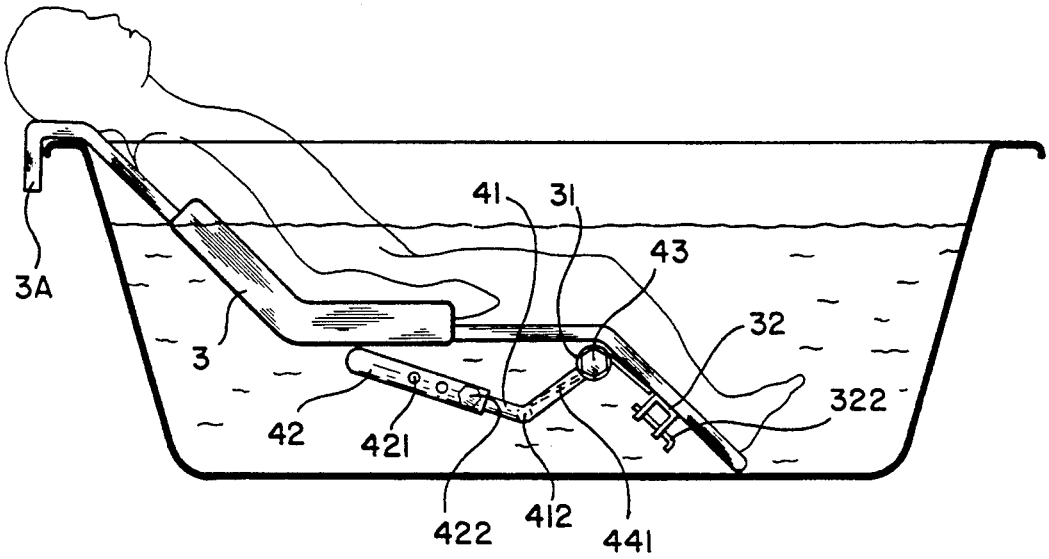
FIG. 4A illustrates the reclining board of the present invention installed in a baby bathtub with the stand collapsed.

The U-shaped supporting tube 42 of the stand 4 is normally retained by the torsional spring 44 in the non-operative position closely attached to the bottom surface of the body 3 (as shown in FIG. 4A). The stand 4 may be turned outwards from the non-operative position to the operative position to support the rear end of the body 3 above the bottom of a baby bathtub. By turning the U-shaped supporting tube 42 away from the bottom surface of the body 3 and inserting the cross rod 412 of the stand 4 past the sloping guide edge 3221 of the latch 322 into the channel casing 32 for permitting the cross rod 412 to be locked in the channel casing 32 by the latch 322, the stand 4 is firmly retained in the operative position (as shown in FIG. 3). When turning the stand 4 from the non-operative position to the operative position, the torsional spring 4 is compressed. As the cross rod 412 is inserted against the sloping guide edge 3221 of the latch 322 within the channel casing 32, the coil spring 323 is compressed, and the latch 322 is squeezed backwards (namely, outwards) for letting the cross rod 412 to pass. Once the cross rod 412 passes through the the sloping guide edge 3221 of the latch 322, the coil spring 323 immediately pushes the latch 322 back to its former position, and therefore the cross rod 412 becomes locked inside the channel casing 32 by the latch 322. By pulling the handle 3223 of the latch 322 backwards (see the dotted line in FIG. 2B) to compress the coil spring 323, the cross rod 412 is released from the locking of the latch 322, and therefore the cross rod 412 can be turned out of the channel casing 32 back to the non-operative position. Once the cross rod 412 is moved out of the channel casing 32, the torsional spring 44 immediately pushes the stand 4 to the non-operative position.

Referring to FIG. 4A, the body 3 of the reclining board is placed in a baby bathtub with the hook 3A hooked on an outside top edge of the baby bathtub at one end. As the stand 4 is received in the non-operative position, almost the whole area of the body 3 is dipped in water, and therefore the body of the baby being carried on the reclining board in the baby bathtub is dipped in water for washing.

Referring to FIG. 4B, as the stand 4 is turned to the operative position to support the body 3 above the bottom of the baby bathtub, the top surface of the body 3 is supported above the water, and therefore the mother or nurse can apply a soap to the baby lying on the reclining board.

Figure 1:
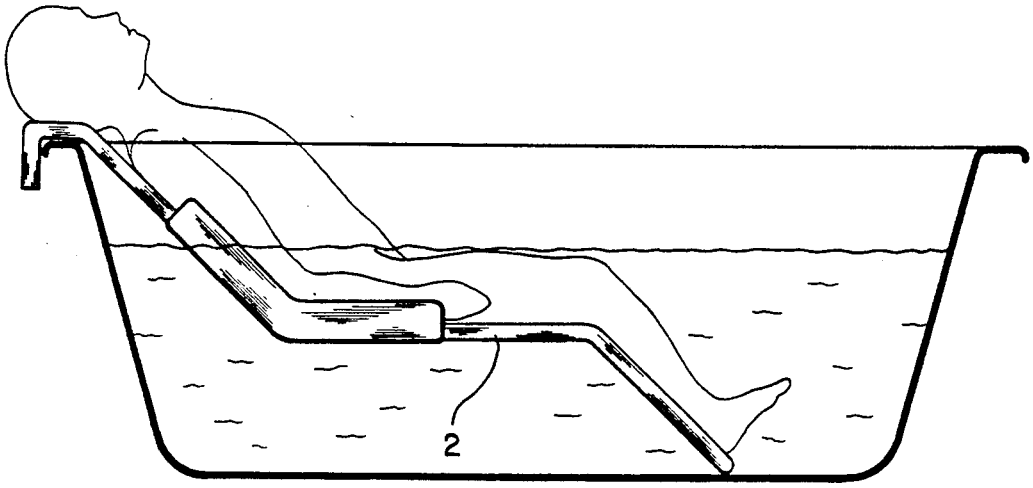
FIG. 1 (PRIOR ART)
FIG. 1 illustrates a prior art reclining board installed in a baby bathtub to carry a baby.
Figure 5:
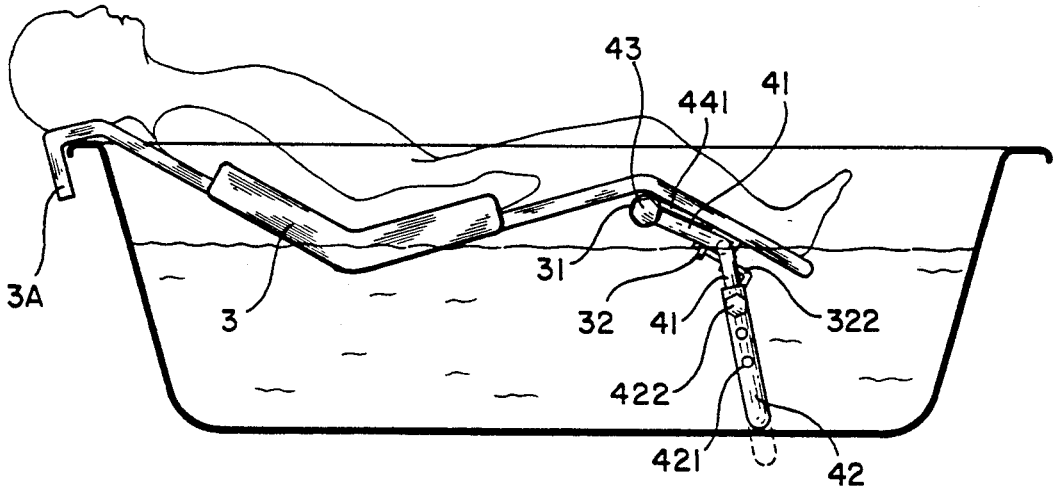
FIG. 5 is similar to FIG. 4B but showing the total height of the stand adjusted.

Referring to FIG. 5, the elevation of the rear end of the body 3 above the bottom of the baby bathtub can be adjusted by changing the connecting points between the eye end rods 41 and the two opposite ends of the U-shaped supporting tube 42.

While only one embodiment of the present invention has been shown and described, it will be understood that various modifications and changes could be made without departing from the spirit and scope of the invention. For example, two or more torsional springs may be mounted around the cross rod 412 to retain the U-shaped stand in the non-operative position; any suitable spring means may be used to replace the coil spring 323.

What is claimed is:

1. A reclining board for carrying a baby in a baby bathtub, comprising:

a board made in an oblong FIGURE for carrying a baby, said board comprising a unitary hook projected from a front end thereof for hooking on one end of a thereof at the bottom of said board and two spaced barrels bilaterally disposed at the bottom of said board near said locking device, said locking device comprising a channel casing fastened to said board at the bottom, said channel casing having an elongated open groove and a slot on an outer side wall thereof in communication with said open groove, a latch having a front end inserted into said slot and retained inside said channel casing by a pin and a rear end terminated to a handle disposed outside said channel casing, a spring mounted around said latch and retained between said pin and said channel casing, the front end of said latch having a sloping guide edge at the bottom of said latch:

a stand pivotably connected to said barrel by a pivot bolt and alternatively retained by at least one torsional spring in a non-operative position closely received to the bottom of said board or an operative position to support the rear end of said board above the bottom of said baby bathtub, said stand comprising two eye end rods parallelly joined by a cross rod in the middle, and a substantially U-shaped supporting tube having two opposite ends respectively connected to said eye end rods, each eye end rod having one end terminated to an eye connected to either barrel by said pivot bolt and a plain opposite end inserted into either end of said U-shaped supporting tube, the plain end of each eye end rod having a through hole connected to either of a series of longitudinally spaced through holes on either end of said U-shaped supporting tube by a respective screw bolt, said at least one torsional spring being respectively mounted around said pivot bolt, each torsional spring having one end stopped against said board and an opposite end stopped against said cross rod;

whereby said stand is moved from said nonoperative position to said operative position by turning said U-shaped supporting tube outwards to compress each of said at least one torsional spring, for permitting said cross rod to be inserted into said elongated open groove and locked in place by said latch; the elevation of said board on said stand is adjusted by connecting the through holes on said eye end rods to different through holes on said U-shaped supporting tube.

* * * * *